US009446283B2

(12) United States Patent
Nelson

(10) Patent No.: US 9,446,283 B2
(45) **Date of Patent: *Sep. 20, 2016**

(54) TOP-LOADING ADJUSTABLE WEIGHT KETTLEBELL SYSTEM

(71) Applicant: Preston Nelson, West Linn, OR (US)

(72) Inventor: Preston Nelson, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/702,838

(22) Filed: May 4, 2015

(65) Prior Publication Data

US 2015/0231440 A1 Aug. 20, 2015

Related U.S. Application Data

(63) Continuation of application No. 13/726,530, filed on Dec. 24, 2012, now Pat. No. 9,022,906.

(60) Provisional application No. 61/579,395, filed on Dec. 22, 2011.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 23/035*** | (2006.01) |

(52) U.S. Cl.

CPC ..... *A63B 21/075* (2013.01); *A63B 21/1469* (2013.01); *A63B 23/03508* (2013.01)

(58) Field of Classification Search

CPC .... A63B 21/00; A63B 21/06; A63B 21/072; A63B 21/0724; A63B 21/0726; A63B 21/0728; A63B 21/075

USPC ..... 482/92–93, 106–108

See application file for complete search history.

(56) References Cited

U.S. PATENT DOCUMENTS

| | | | | | |
|---|---|---|---|---|---|
| 907,965 | A * | 12/1908 | Calvert | A63B 21/075 | 482/108 |
| 1,524,888 | A * | 2/1925 | Schuur | A63B 21/0605 | 482/108 |
| 3,913,908 | A * | 10/1975 | Speyer | A63B 21/0728 | 482/106 |
| 4,076,236 | A * | 2/1978 | Ionel | A63B 21/0602 | 482/106 |
| 4,109,908 | A * | 8/1978 | Pugh | A63B 21/065 | 482/105 |
| 4,431,185 | A * | 2/1984 | Cisneros | A63B 21/072 | 220/318 |
| 4,566,690 | A * | 1/1986 | Schook | A63B 21/0728 | 482/106 |
| 5,072,933 | A * | 12/1991 | Diodati | A63B 21/072 | 482/93 |

(Continued)

*Primary Examiner* — Stephen Crow
*Assistant Examiner* — Garrett Atkinson
(74) *Attorney, Agent, or Firm* — Brooklyn Law IP Clinic; Serge Krimnus; Suzanne A. Mourad

(57) ABSTRACT

Preferred top-loading adjustable weight kettlebell systems described herein preferably include a kettlebell base and at least one top-loading nesting weight. The kettlebell base preferably include a main body and a handle, the main body having a substantially convex upper surface, the handle upwardly extended from the main body. The at least one top-loading nesting weight preferably has a handle opening defined therein. The at least one top-loading nesting weight may have a substantially convex upper surface and a substantially concave lower surface. The at least one top-loading nesting weight is preferably loadable onto the kettlebell base by insertion of the handle through the handle opening. Preferred top-loading adjustable weight kettlebell systems may include a two-part securing mechanism for securement between the kettlebell base and the at least one top-loading nesting weight.

21 Claims, 15 Drawing Sheets

(56) References Cited

U.S. PATENT DOCUMENTS 5,102,124 A * 4/1992 Diodati ..... A63B 21/0605 482/106
5,213,557 A * 5/1993 Firth ..... A63B 23/20 482/105
5,354,247 A * 10/1994 Wilkinson ..... A47C 3/20 206/505
5,607,379 A * 3/1997 Scott ..... A63B 21/0724 482/107
5,735,777 A * 4/1998 Benoit ..... A63B 21/0728 482/106
5,967,952 A * 10/1999 Bronstein ..... A63B 21/0602 482/105
6,322,481 B1 * 11/2001 Krull ..... A63B 21/0728 482/106
6,387,022 B1 * 5/2002 Smith ..... A63B 65/06 482/106
6,461,282 B1 * 10/2002 Fenelon ..... A63B 21/0601 482/106
6,544,148 B1 * 4/2003 Loew ..... A63B 21/0728 482/82
7,011,611 B1 * 3/2006 Ripley ..... A63B 21/0728 482/107
7,381,157 B2 * 6/2008 Blateri ..... A63B 21/075 482/106
7,491,157 B1 * 2/2009 Lin ..... A63B 21/0728 482/107
7,563,208 B1 * 7/2009 Chen ..... A63B 21/075 482/108
7,588,520 B2 * 9/2009 Nalley ..... A63B 21/0728 482/103
7,811,212 B2 * 10/2010 Chen ..... A63B 21/072 482/106
7,824,319 B2 * 11/2010 Carlesimo ..... A63B 21/00047 446/85
7,976,443 B2 * 7/2011 Krull ..... A63B 21/0728 482/107
8,021,282 B2 * 9/2011 Polevoy ..... A63B 21/0728 482/108
D652,877 S * 1/2012 Dalebout ..... D21/682
2002/0002106 A1 * 1/2002 Krull ..... A63B 21/0728 482/107
2007/0135274 A1 * 6/2007 Blateri ..... A63B 21/075 482/109
2008/0081744 A1 * 4/2008 Gormley ..... A63B 21/0728 482/93
2008/0153678 A1 * 6/2008 McClusky ..... A63B 21/06 482/106
2009/0247378 A1 * 10/2009 Carlesimo ..... A63B 21/00047 482/141
2010/0075816 A1 * 3/2010 Anderson ..... A63B 21/0728 482/107
2010/0210427 A1 * 8/2010 Yu ..... A63B 21/075 482/93
2010/0331151 A1 * 12/2010 Signorile ..... A63B 21/00196 482/93
2011/0207583 A1 * 8/2011 Elpers ..... A63B 23/0458 482/52
2011/0263392 A1 * 10/2011 Yu ..... A63B 21/072 482/93
2013/0040789 A1 * 2/2013 Kessler ..... A63B 21/072 482/108
2013/0137555 A1 * 5/2013 Hodes ..... A63B 21/0726 482/106

* cited by examiner

TOP-LOADING ADJUSTABLE WEIGHT KETTLEBELL SYSTEM

The present application claims the benefit under 35 U.S.C. 120 of U.S. patent application Ser. No. 13/726,530, which was filed on Dec. 24, 2012 in the United States Patent and Trademark Office, which claims the benefit of U.S. Provisional Patent Application Ser. No. 61/579,395, filed Dec. 22, 2011. The present application is based on and claims priority from these applications, the disclosure of each of which is hereby expressly incorporated herein by reference in its entirety.

BACKGROUND OF THE INVENTION

Disclosed herein is a kettlebell and, more specifically, a top-loading adjustable weight kettlebell system.

In the health/fitness or exercise industry, kettlebell training is considered one of the best calorie burning exercises as well as muscle toning exercises available. A typical kettlebell is a weight that resembles a cannonball with a handle. A kettlebell may be used to perform ballistic exercises that combine cardiovascular, strength and flexibility training.

Adjustable weight kettlebells are advantageous for limiting equipment storage requirements. In one example, an adjustable kettlebell requires a tool to adjust the weight; however, this kettlebell is not quick or easy to use, especially for an exerciser wishing to maintain an elevated heart rate. In another example, an adjustable weight kettlebell uses a "pin" to lock additional weights in place. In this example, there is a concern about the "pin" not securely locking the weights in place, especially when executing full body "swing" movements. In both of the above examples, additional weights are loaded and/or unloaded from the bottom or the side (relative to the top portion that is a location of the handle) of the kettlebell.

U.S. Pat. Nos. 8,033,965, D644,701, 8,012,069, 7,976,443, 7,811,212, 7,811,212, 7,731,640, 7,563,208, D522,595, D522,594, and 4,773,640 and U.S. Patent Application Publication Nos. 2010/0248910 and 2008/0081744 represent various adjustable weight kettlebells. These references are hereby incorporated by reference in their entirety.

Adjustable weight kettlebells having hollow interiors are known. U.S. Patent Application Publication No. 2010/0248910 to DiLuglio (the "DiLuglio reference") is an example of a hollow kettlebell. The DiLuglio reference describes a kettlebell having a hollow interior portion, and a substantially flat surface upon which the kettlebell may rest. The interior portion is lined with a water-impervious coating. The DiLuglio reference also provides an alternative in which the interior portion may have a water-impervious bladder disposed therein.

Adjustable weight kettlebells having weights that attach below the handle are known. U.S. Patent Application Publication No. 2008/0081744 to Gormley (the "Gormley reference") is an example of an adjustable kettlebell that uses a series of plate weights (plates) in stacked relationship below the handle. A handle having a shaft passes through the plate weights. A base plate weight is engageable with the shaft for holding the plates together.

BRIEF SUMMARY OF THE INVENTION

Disclosed herein is a kettlebell and, more specifically, a top-loading adjustable weight kettlebell system.

Described herein is a top-loading adjustable weight kettlebell system that includes a kettlebell base and at least one top-loading nesting weight. The kettlebell base may include a main body and a handle that extends from the main body. The at least one top-loading nesting weight has a handle opening defined therein. The at least one top-loading nesting weight is loadable onto the kettlebell base by insertion of the handle through the handle opening.

The top-loading adjustable weight kettlebell system may include a two-part securing mechanism for securement between the kettlebell base and the at least one top-loading nesting weight, one part of the two-part securing mechanism associated with the kettlebell base and one part of the two-part securing mechanism associated with the at least one top-loading nesting weight. The top-loading adjustable weight kettlebell system may include a two-part securing mechanism for securement between the kettlebell base and the at least one top-loading nesting weight, at least one part of the two-part securing mechanism being a magnet. The top-loading adjustable weight kettlebell system may include a securing mechanism for securement between the kettlebell base and the at least one top-loading nesting weight, wherein the securing mechanism is a magnetic securing mechanism, the magnetic securing mechanism may include at least one magnet associated with the top-loading nesting weight and at least one magnet associated with the main body.

Preferred top-loading adjustable weight kettlebell systems may have a main body having a wider bottom portion having a substantially circular shape, a narrower top portion having a substantially circular shape, and a curved side wall that extends between the narrower top portion and the wider bottom portion.

Preferred top-loading adjustable weight kettlebell systems may have a main body defining a cavity.

Preferred top-loading adjustable weight kettlebell systems may have an attachment structure associated with the main body. Preferred top-loading adjustable weight kettlebell systems may have an attachment structure associated with the main body, the attachment structure being suitable for attachment to a resistance system or device. Preferred top-loading adjustable weight kettlebell systems may have an attachment structure associated with the main body, the attachment structure positioned within a cavity of the main body. Preferred top-loading adjustable weight kettlebell systems may have an attachment structure associated with the main body, the attachment structure positioned within a cavity of the main body, and the attachment structure being suitable for attachment to a resistance system or device.

The top-loading adjustable weight kettlebell system may have an elongated handle that is elongated to accommodate a plurality of stacked top-loading nesting weights.

Preferred top-loading nesting weights may have a substantially convex upper surface and a substantially concave lower surface. Preferred top-loading nesting weights may have a substantially convex upper surface and a substantially concave lower surface, the substantially concave lower surface for nesting with an upper surface of the main body or an upper surface of a lower adjacent nested top-loading nesting weight.

The at least one top-loading nesting weight may have an at least partial overhanging lip edge, the at least partial overhanging lip edge having a lower surface that is in spaced relation with a surface therebelow.

One preferred top-loading adjustable weight kettlebell system may include a kettlebell base and at least one top-loading nesting weight. The kettlebell base may include a main body and a handle, the main body having a substantially convex upper surface, the handle upwardly extended from the main body. The at least one top-loading nesting weight may have a handle opening defined therein. The at least one top-loading nesting weight may have a substantially convex upper surface and a substantially concave lower surface. The at least one top-loading nesting weight is preferably loadable onto the kettlebell base by insertion of the handle through the handle opening. A two-part securing mechanism for securement between the kettlebell base and the at least one top-loading nesting weight may include one part of the two-part securing mechanism associated with the kettlebell base and one part of the two-part securing mechanism associated with the at least one top-loading nesting weight.

The subject matter described herein is particularly pointed out in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary top-loading adjustable weight kettlebell systems and top-loading nesting weights and/or provide teachings by which the various exemplary top-loading adjustable weight kettlebell systems and top-loading nesting weights are more readily understood.

Figure 1:
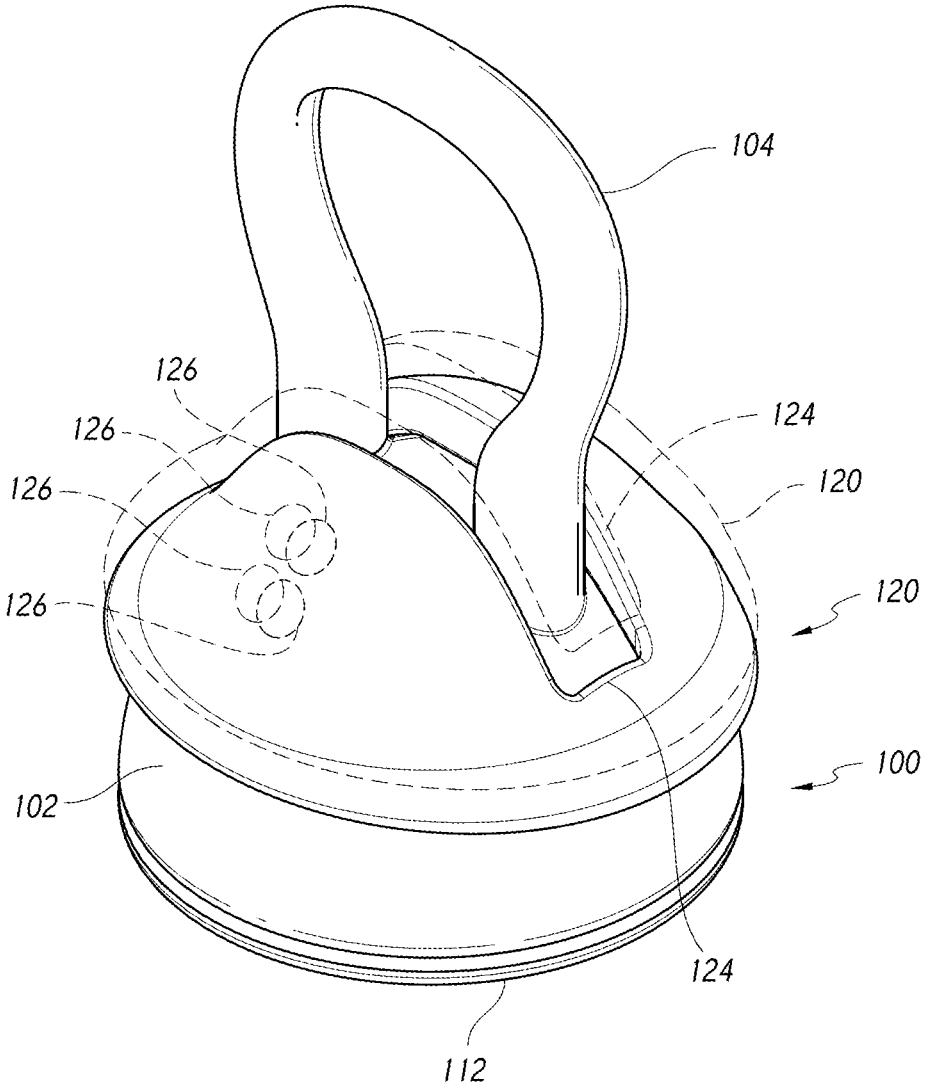
FIG. 1 is a perspective view of an exemplary top-loading adjustable weight kettlebell system including a kettlebell base and two exemplary top-loading nesting weights, the upper top-loading nesting weight being shown in phantom.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

Disclosed herein is a top-loading adjustable weight kettlebell system. As shown in FIGS. 1-17, the top-loading adjustable weight kettlebell system includes a kettlebell base 100 (an example of which is shown in FIGS. 6-10) and one or more top-loading nesting weights 120 (an example of which is shown in FIGS. 11-15). The kettlebell base 100 preferably includes a main body 102 associated with a handle 104. An elongate handle opening (slot) 124 is defined in each of the top-loading nesting weights 120. The top-loading nesting weights 120 are loaded from the top of the kettlebell base 100 by inserting the handle 104 through the handle openings 124 or, put another way, the top-loading nesting weight 120 is slipped over the handle 104. Securing mechanisms 106, 126 (e.g. magnets) secure the top-loading nesting weights 120 to the kettlebell base 100.

The top-loading adjustable weight kettlebell systems described herein have many advantages over previously described adjustable weight kettlebells. For example, by using the presently described top-loading adjustable weight kettlebell systems, a user may easily and quickly adjust the amount of weight he uses. Specifically, by loading and/or unloading the top-loading nesting weights 120 from the top, additional top-loading nesting weights 120 may be quickly added or removed. Further, by using securing mechanisms 106, 126 (e.g. magnets) to secure the top-loading nesting weights 120, additional top-loading nesting weights 120 may be quickly secured or unsecured. Further, the presently described top-loading adjustable weight kettlebell systems may have additional features that allow for more dynamic exercise capabilities.

Exemplary top-loading adjustable weight kettlebell systems may be better understood with reference to the drawings, but these shown top-loading adjustable weight kettlebell systems are not intended to be of a limiting nature.

Before describing the top-loading adjustable weight kettlebell systems and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The term "kettlebell" is generally used to define a heavy weight with a single handle that intersects the weight in two places. It should be noted, however, that alternative kettlebells may have handles that have a single intersection with the weight. As described herein, the main body 102 is the "heavy weight" of the kettlebell.

The term "substantially" is meant to convey an overall impression. For example, the top-loading nesting weight 120 is described as having an upper surface that is a "substantially convex surface" and a lower surface that is a "substantially concave surface." The upper and lower surfaces would still be considered substantially convex/concave even if a portion is not convex/concave. For example, the presence of an at least partial flared lip edge 130 at the outer rim of the top-loading nesting weights 120 would not change the overall impression of the upper surface being substantially convex and the lower surface being substantially concave. On the other hand, a substantially flat plate weight with a small annular downward projection at its rim would not be considered substantially convex/concave.

Unless specifically stated otherwise, the terms "first," "second," and "third" are meant solely for purposes of designation and not for order or limitation. For example, the "first preferred exemplary top-loading adjustable weight kettlebell system" has no order relationship with the "second preferred exemplary top-loading adjustable weight kettlebell system."

It should be noted that the terms "may," "might," "can," and "could" are used to indicate alternatives and optional features and only should be construed as a limitation if specifically included in the claims. For example, the phrase "the top-loading adjustable weight kettlebell system may include attachment structure" indicates that the attachment structure is optional. It should be noted that the various components, features, steps, materials, or embodiments thereof are all "preferred" whether or not it is specifically indicated. Claims not including a specific limitation should not be construed to include that limitation.

It should be noted that relative terms are meant to help in the understanding of the technology and are not meant to limit the scope of the invention. For example, the term "top" is meant to be relative to the term "bottom," the term "above" is meant to be relative to the term "below," the term "upward" is meant to be relative to the term "downward," and the term "back" is meant to be relative to the term "front." Rotating a component may change the terminology, but not the meaning. (For example, if the kettlebell base 100 is held upside-down, the handle 104 would be below the main body 102.)

Unless specifically stated otherwise, the term "exemplary" is meant to indicate an example, representative, and/or illustration of a type. The term "exemplary" does not necessary mean the best or most desired of the type.

The term "associated" is defined to mean integral or original, retrofitted, attached, embedded, connected (including functionally connected), positioned near, and/or accessible by.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, or comprises A and B contains A and B, but optionally may contain C or additional components other than A and B). It should be noted that, unless otherwise specified, the singular forms "a," "an," and "the" refer to one or more than one, unless the context clearly dictates otherwise.

Base

As shown in FIGS. 1-10, the kettlebell base 100 of the top-loading adjustable weight kettlebell system described herein preferably includes a main body 102 associated with a handle 104. The main body 102 of the kettlebell base 100 is relatively positioned below the handle 104 (e.g. substantially positioned at the bottom of the two sides of the handle 104). Put another way, handle 104 extends upwardly from the main body 102. Preferred handles 104 may intersect the main body 102 in two places. The kettlebell base 100 has a first weight amount, such as, for example, twenty pounds (20 lbs).

Figure 18:
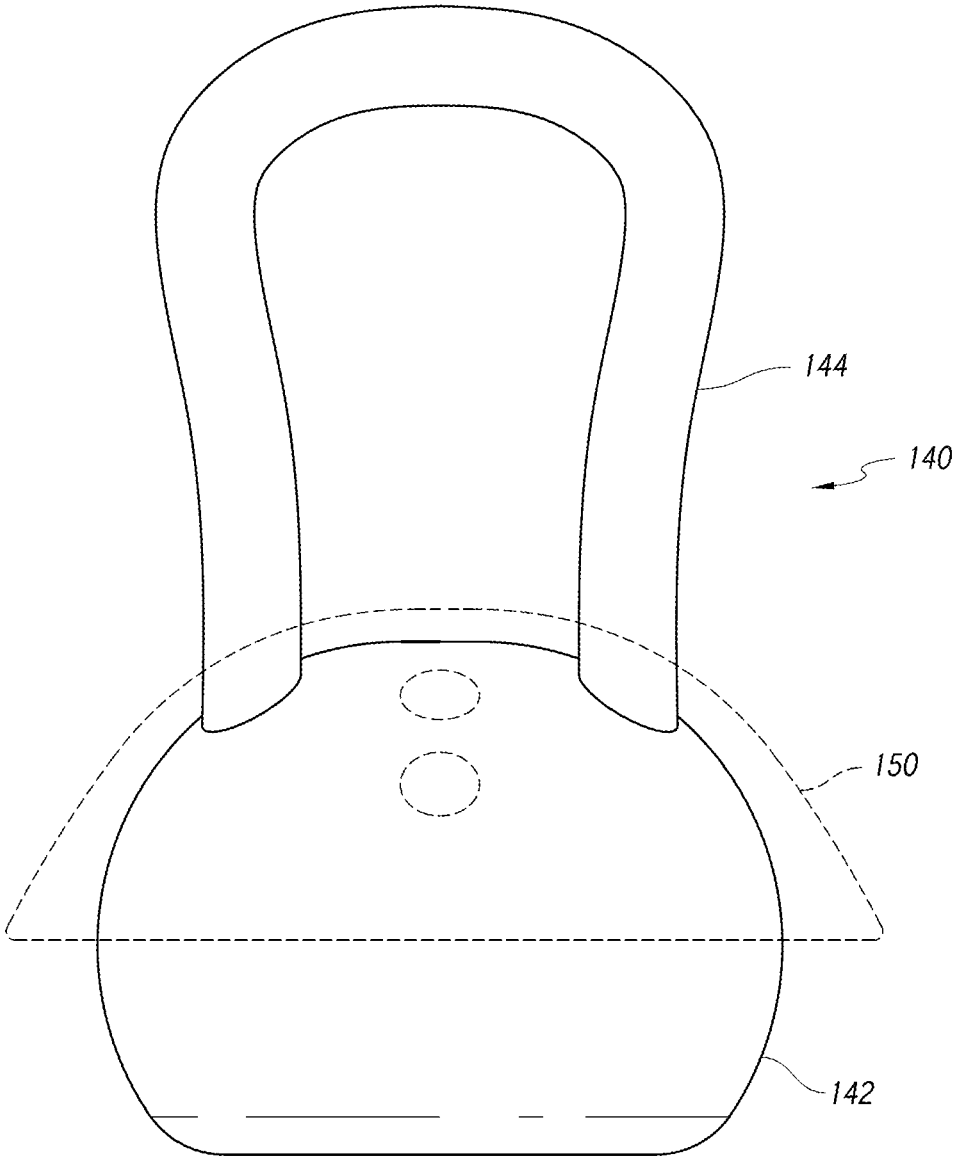
FIG. 18 is a front view of a first alternative top-loading adjustable weight kettlebell system with an alternative kettlebell base an alternative top-loading nesting weight (shown in phantom).
Figure 19:
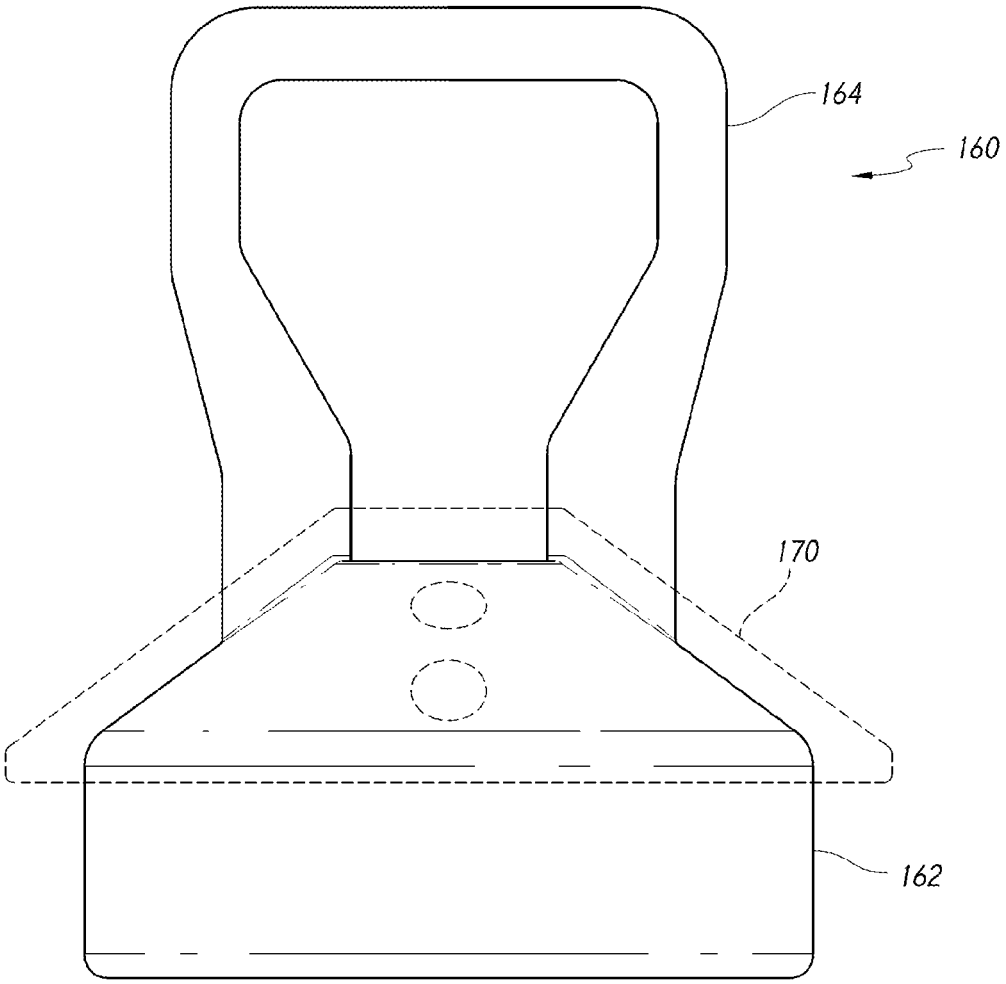
FIG. 19 is a front view of a second alternative top-loading adjustable weight kettlebell system with an alternative kettlebell base an alternative top-loading nesting weight (shown in phantom).

The main body 102 of the kettlebell base 100 preferably has a bottom portion 110*b* (FIG. 7) that is wider than its top portion 110*a* (FIG. 7) and curved side-walls joining the top portion to the bottom portion. For example, the main body 102 may have a substantially semi-spherical shape (albeit with minor variations such as a flattened top) with its widest portion on the bottom. Alternative shapes may include cones (or rounded versions of a cone), pyramids (or rounded versions of a pyramid), partial polyhedrons (or rounded versions of a partial polyhedron), three-dimensional shapes with U-shaped cross-sections, or other appropriate shapes. FIGS. 18 and 19 show examples alternative kettlebell bases 140, 160 with main bodies 142, 162 having alternative shapes. The wider bottom portion 110*b* of the kettlebell may provide a stable base 100 for executing pushups and dips. As compared to typical kettlebells that generally are substantially spherical with only a small flat surface, the wider bottom portion (that may include a circular rim) of the kettlebell described herein is much more stable.

Figure 2:
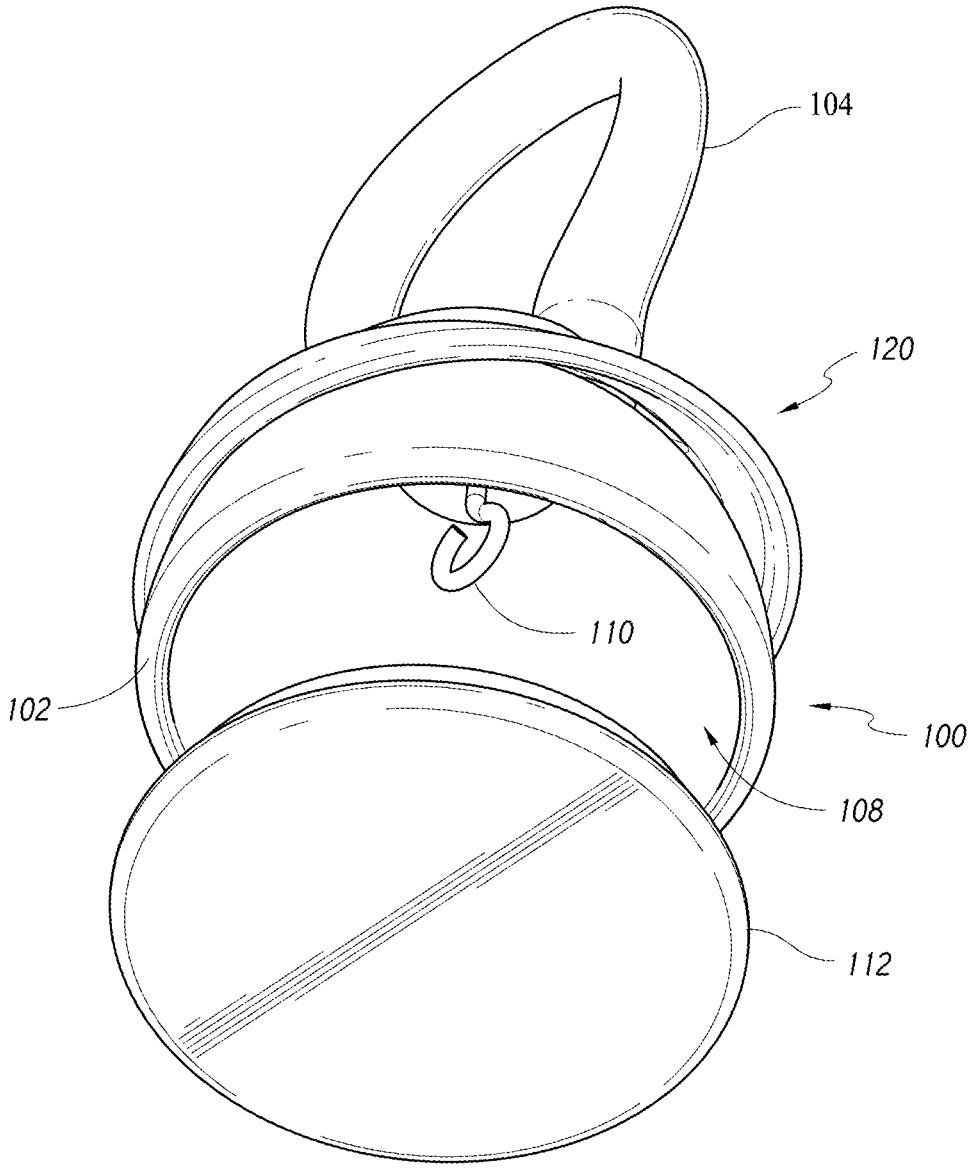
FIG. 2 is a bottom perspective view of an exemplary top-loading adjustable weight kettlebell system including a kettlebell base and an exemplary top-loading nesting weight, a body enclosure cover being removed to expose an interior cavity of the body of the kettlebell base.
Figure 16:
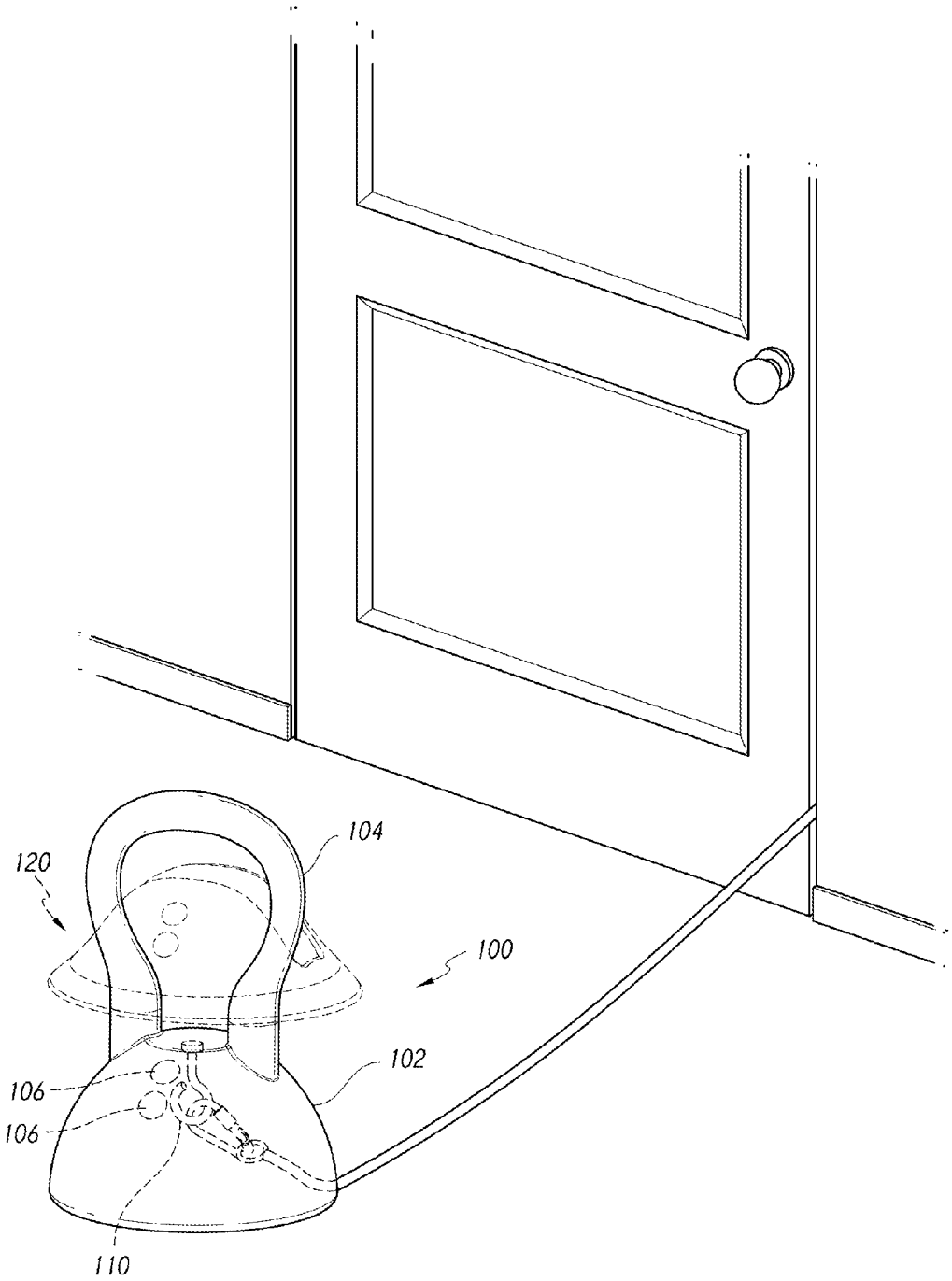
FIG. 16 is an environmental view of an exemplary kettlebell base attached to a closed door via an elongated flexible lead, an exemplary top-loading nesting weight shown being partially loaded or partially unloaded is shown in phantom.

The main body 102 of the kettlebell base 100 may be at least partially hollow or concave. Put another way, the main body 102 of the kettlebell base 100 may define a cavity 108 (FIG. 2). As will be discussed, attachment structure 110 may be positioned within the cavity 108 of the main body 102. The main body 102 may have an associated body enclosure cover 112 (or other covering that may be scratch resistant) that covers the open bottom of the main body 102 of the kettlebell base 100. Put another way, the body enclosure cover 112 may be used to seal or encapsulates the cavity so that the cavity is suitable for storage. Exercise components 114 (FIG. 3) (e.g. handles, grips, carabiners, clips, tubing, cables, cords, elastic, and/or rubber bands), attachment devices (e.g. devices for attaching the kettlebell base via an elongated flexible lead to a doorknob and/or a closed door as shown in FIG. 16), written instructions, DVDs, or other items may be placed within the cavity of the main body 102 and the body enclosure cover 112 may be used as a seal to retain the stored items.

The handle 104 is shown as being elongated to accommodate stacked top-loading nesting weights 120. The actual height of the handle 104 would be determined by the intended use (e.g. longer handles for stronger users). This is shown in the split handle of FIGS. 6-8. The top of the handle 104 may have ergonomically designed "C" or "D" shape that provides added comfort and security while using the kettlebell. The actual shape of the handle 104 may also be designed to be considered attractive and/or ornamental. FIGS. 18 and 19 show examples alternative kettlebell bases 140, 160 with handles 144, 164 having alternative shapes.

For unitary top-loading adjustable weight kettlebell systems, the kettlebell base 100 (including the main body 102 and the handle 104) may be cast, molded, or otherwise manufactured as a single piece, and distinct joining mechanisms would not be necessary. A unitary top-loading adjustable weight kettlebell system may also have a kettlebell base 100 in which the main body 102 and the handle 104 are permanently joined (so that a user would find it difficult or impossible to remove) using known methods (e.g. welding). Alternative manufacturing methods may be used to create the kettlebell base 100 (including the main body 102 and the handle 104) and the disclosed methods are only used as examples.

Although the kettlebell base 100 is shown and discussed as having an unitary or integral main body 102 and handle 104, alternative preferred kettlebell bases 100 could be constructed using separate components that are joined together removably (so that a user could remove the handle 104 from the main body 102 for reasons such as replacement or storage). Such an alternative preferred top-loading adjustable weight kettlebell system might include a distinct handle 104, a distinct main body 102, and at least one joining mechanism (e.g. a locking collar, bolts, or other structure suitable to joining the handle 104 to the main body 102).

The top-loading adjustable weight kettlebell systems described herein may be manufactured from any material composition that achieves the desired weight objectives. In a first example, the handle 104, the main body 102, and/or the top-loading nesting weights 120 may be manufactured from another heavy material such as cast iron and/or other magnetic material (e.g. steel, cobalt, and nickel). The advantage of a magnetic material is that it can be used in conjunction with magnetic securing mechanisms 106, 126 to reinforce the magnetic connection therebetween. In a second example, the main body 102, top-loading nesting weights 120, and/or handle 104 have zinc outer shells, each outer shell filled with 90% or greater lead compound. In a third example, the main body 102, top-loading nesting weights 120, and/or handle 104 have aluminum outer shells, each outer shell filled with 90% or greater lead compound. In a fourth example, at least one of the main body 102, top-loading nesting weights 120, and/or handle 104 have a zinc outer shell and at least one of the main body 102, top-loading nesting weights 120, and/or handle 104 have an aluminum outer shell, each outer shell filled with 90% or greater lead compound.

The main body 102, the handle 104, and/or the body enclosure cover 112 may be made from and/or coated with, for example, plastic, rubber, polyurethane, or other material that would prevent the main body 102 of the kettlebell base 100 from scratching surfaces with which they come into contact.

Top-Loading Nesting Weights

FIGS. 1-5 and 11-15 show an exemplary top-loading adjustable weight kettlebell system that preferably accommodates a plurality of top-loading nesting weights 120. For example, FIG. 1 shows a top-loading adjustable weight kettlebell system with a first top-loading nesting weight 120 loaded onto a kettlebell base 100 and a second top-loading nesting weight 120 (in phantom) loaded above the first top-loading nesting weight 120. Increasing or decreasing the thickness of the top-loading nesting weights 120 will allow more or less top-loading nesting weights 120. Similarly, increasing the length of the handle 104 (represented by the split handle of FIGS. 6-8) will allow more top-loading nesting weights 120 to be loaded. Because the kettlebell base 100 may accommodate a plurality of top-loading nesting weights 120, the handle 104 may have an overall narrow elongate shape that extends substantially perpendicular relative to the wider bottom portion of the main body 102.

A top-loading nesting weight 120 may be top-loaded such that the handle 104 of the kettlebell base 100 is inserted through an elongate handle opening (slot) 124 near the top of the top-loading nesting weight 120. The handle opening (slot) 124 is dimensioned such that it is slightly larger (longer and wider) than the largest cross-section of the handle 104. This allows the handle 104 to pass through the handle opening (slot) 124 of the top-loading nesting weight 120.

The top-loading nesting weight 120 has an "upper surface" (the substantially convex surface) and a "lower surface" (the substantially concave surface). One preferred actual shape could be described as substantially cup-shaped (which is shown as semi-spherical) so that the lower surface (the concave surface) substantially mates with either the upper surface (the convex surface) of the main body 102 or with the upper surface of an adjacent nested top-loading nesting weight 120. When positioned on the kettlebell base 100, the lower surface of the "first" top-loading nesting weight 120 is abutted to a upper surface (that may be substantially convex) of the main body 102 of the kettlebell base 100. When positioned on the "first" top-loading nesting weight 120, the lower surface of the "second" top-loading nesting weight 120 is abutted to an "upper surface" of the "first" top-loading nesting weight 120. Each subsequent top-loading nesting weight 120 nests with the prior top-loading nesting weight 120.

The top-loading nesting weight 120 has a second weight amount, such as seven-and-a-half pounds (7.5 lbs). Thus, when the top-loading nesting weight 120 is loaded onto the base 100 (which, for this example, has a first weight of twenty pounds (20 lbs), the combination would have a total weight amount of twenty-seven-and-a-half pounds (27.5 lbs). Further, additional top-loading nesting weights 120 may be added (loaded) over the top of the shown top-loading nesting weight 120 to increase the total weight amount of the example kettlebell. Conversely, the top-loading nesting weight(s) may be removed (unloaded) to decrease the total weight amount until only the weight of the kettlebell remains. By fitting top-loading nesting weights 120 over the handle 104 and being placed on the top of the kettlebell base 100, the top-loading adjustable weight kettlebell system provides the user with a quick and safe means to change the weight of and use the kettlebell without causing significant disruption to the exercise routine so that the user can maintain an increased heart rate.

The top-loading nesting weights 120 may each have the same weight amount, such as each weighing seven-and-a-half pounds (7.5 lbs), or they may have differing weight amounts, such as ten, seven-and-a-half, five, and two-and-a-half pounds (10, 7.5, 5, and 2.5 lbs). Preferably each of the top-loading nesting weights 120 has substantially the same dimensions), allowing top-loading nesting weights 120 to be completely interchangeable. If the top-loading nesting weights 120 have the same dimensions, they may be distinguishable by markings (e.g. having the weight of the top-loading nesting weight 120 stamped or otherwise labeled on the top-loading nesting weight) or in alternative ways (e.g. color). In an alternate top-loading adjustable weight kettlebell system, the top-loading nesting weights 120 may be of different dimensions. For example, a two-and-a-half pounds (2.5 lbs) top-loading nesting weight 120 may be thinner than a five pounds (5 lbs) top-loading nesting weight 120. Put another way, the top-loading nesting weights 120 may be thinner for lower weights and thicker for higher weights, as long as the concave and convex surfaces of the weights are matable.

Figure 5:
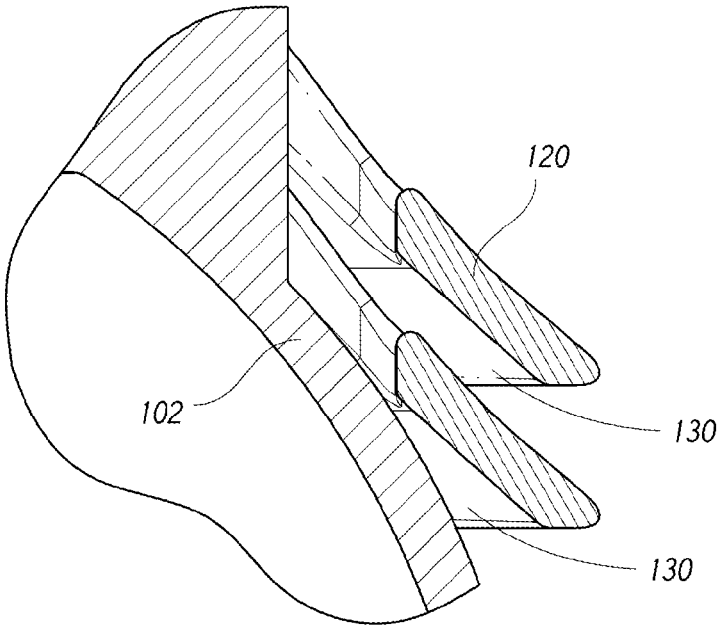
FIG. 5 is a partial cross-sectional view of an exemplary main body of the kettlebell base and two exemplary top-loading nesting weights, the two exemplary top-loading nesting weights having an at least partial overhanging lip edge.
Figure 6:
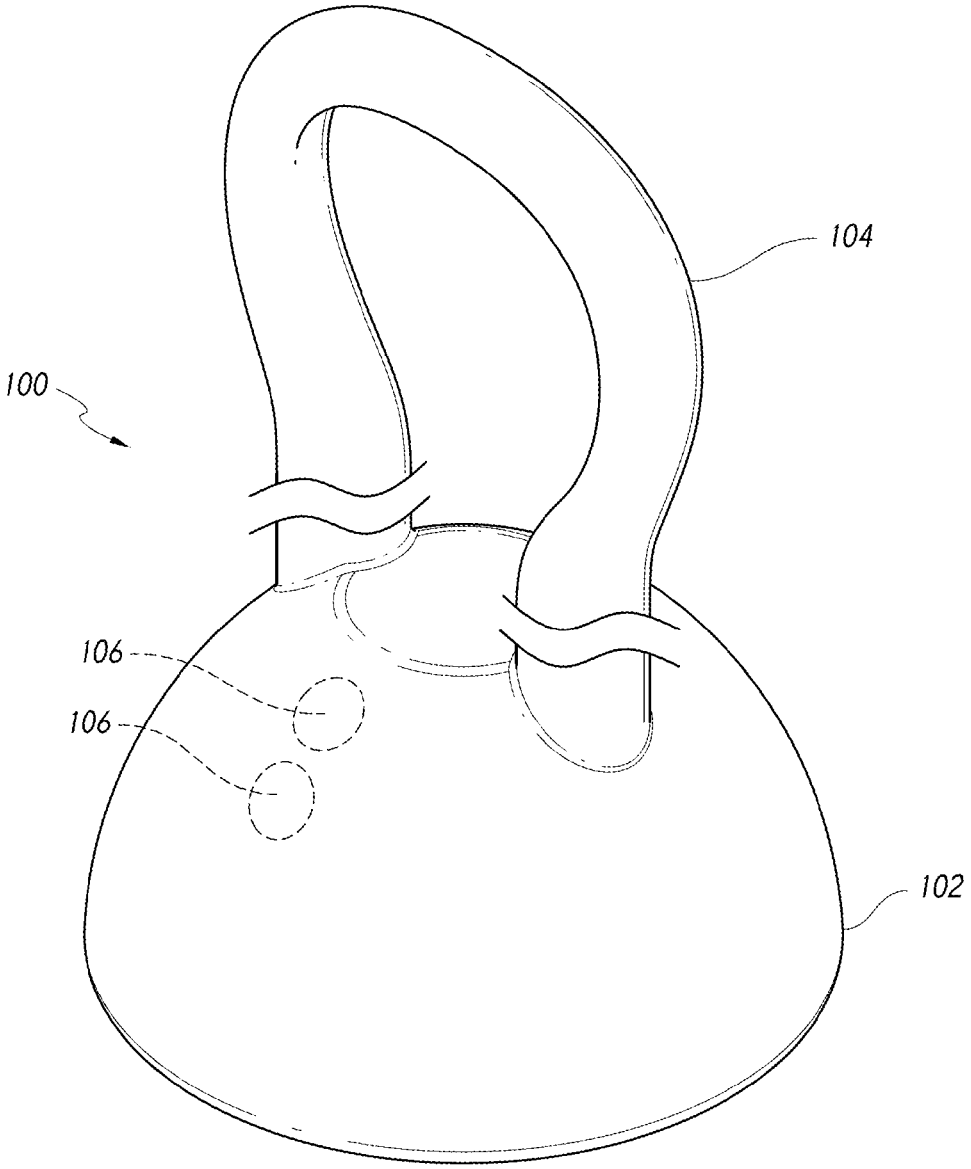
FIG. 6 is a perspective view of an exemplary kettlebell base having a main body and a handle.
Figure 7:
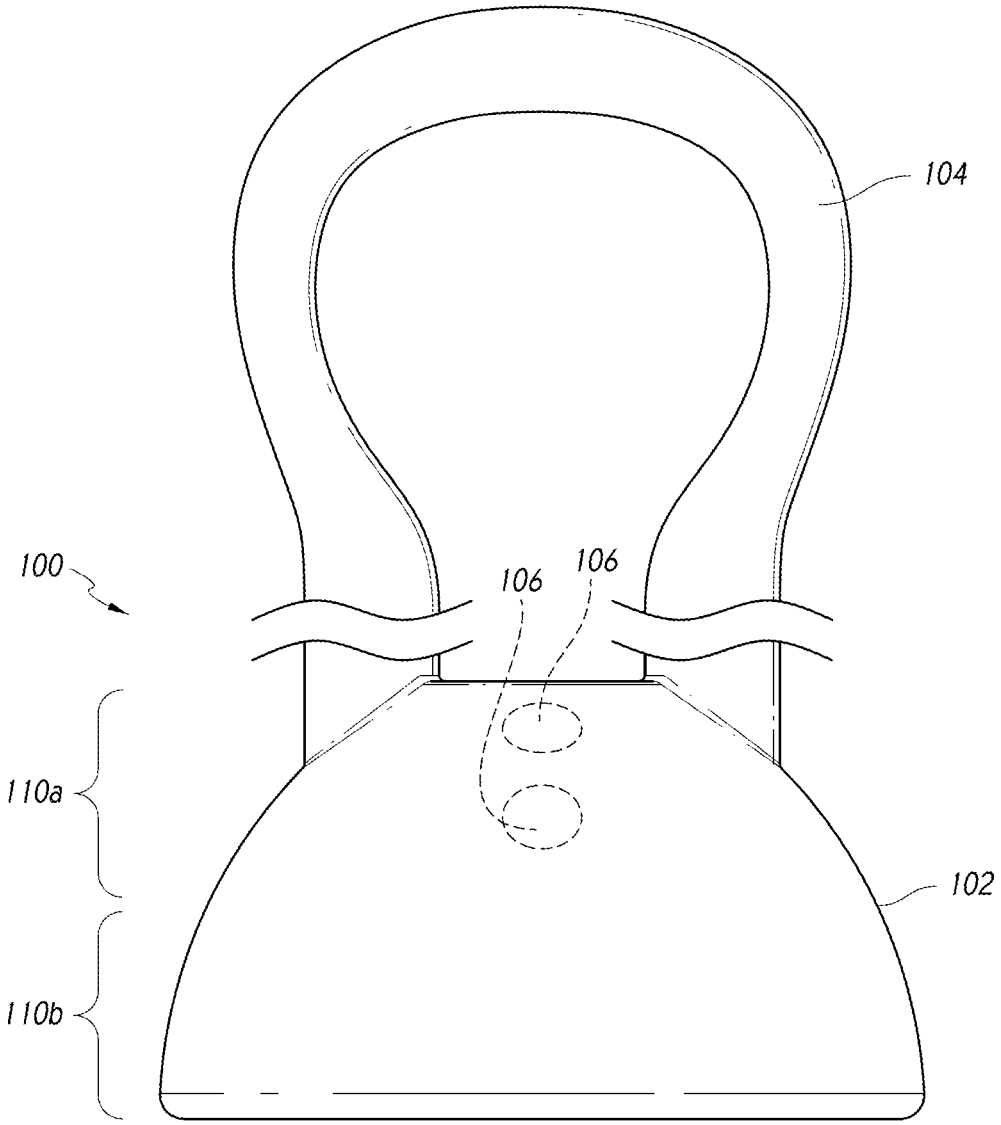
FIG. 7 is a front or back view of an exemplary kettlebell base having a main body and a handle.
Figure 8:
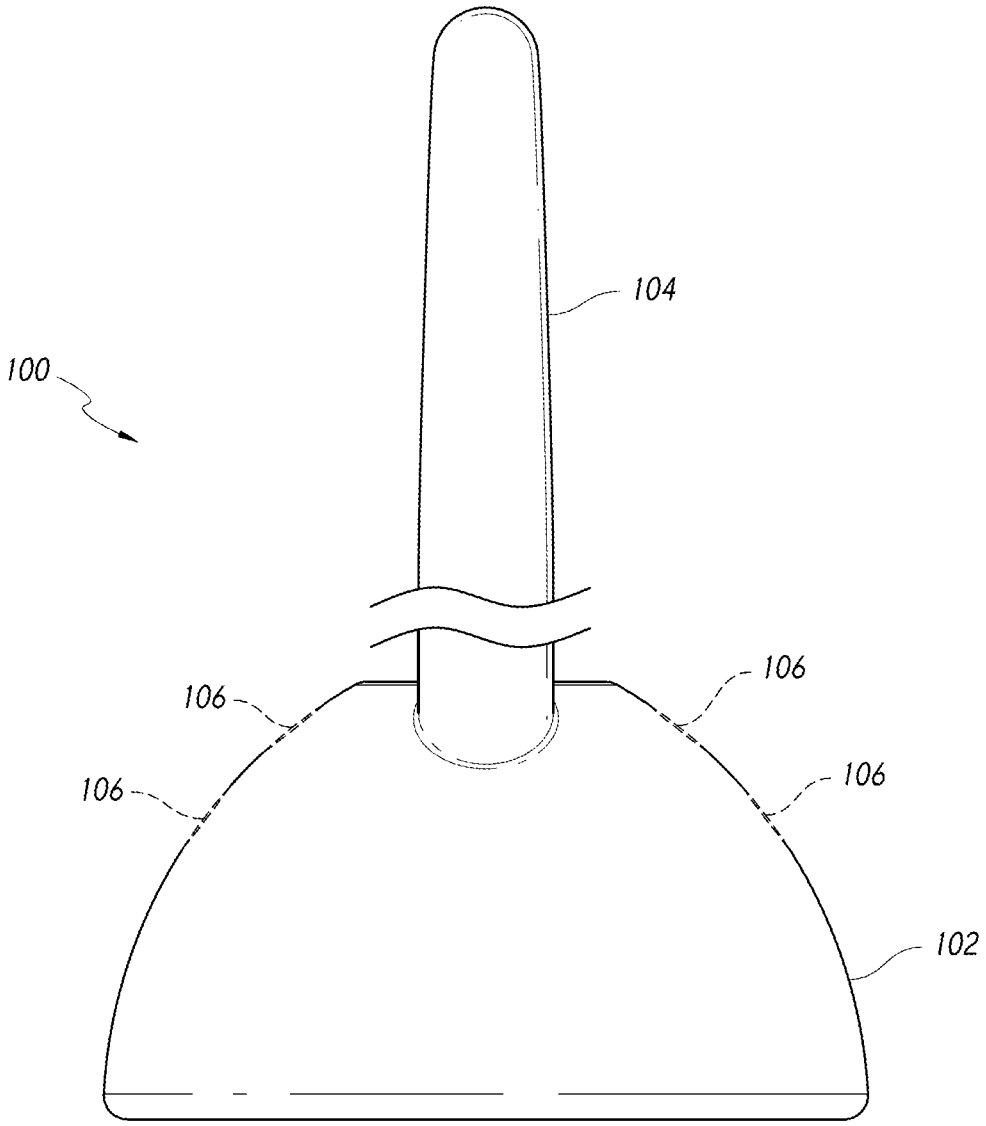
FIG. 8 is a side view of an exemplary kettlebell base having a main body and a handle.
Figure 9:
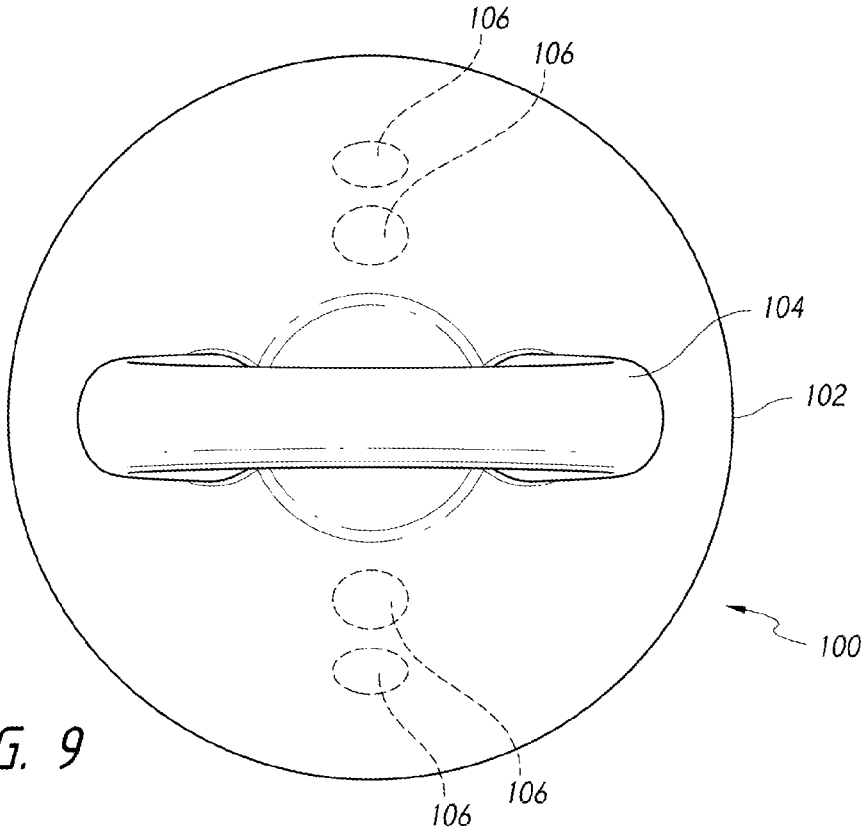
FIG. 9 is a top view of an exemplary kettlebell base having a main body and a handle.
Figure 10:
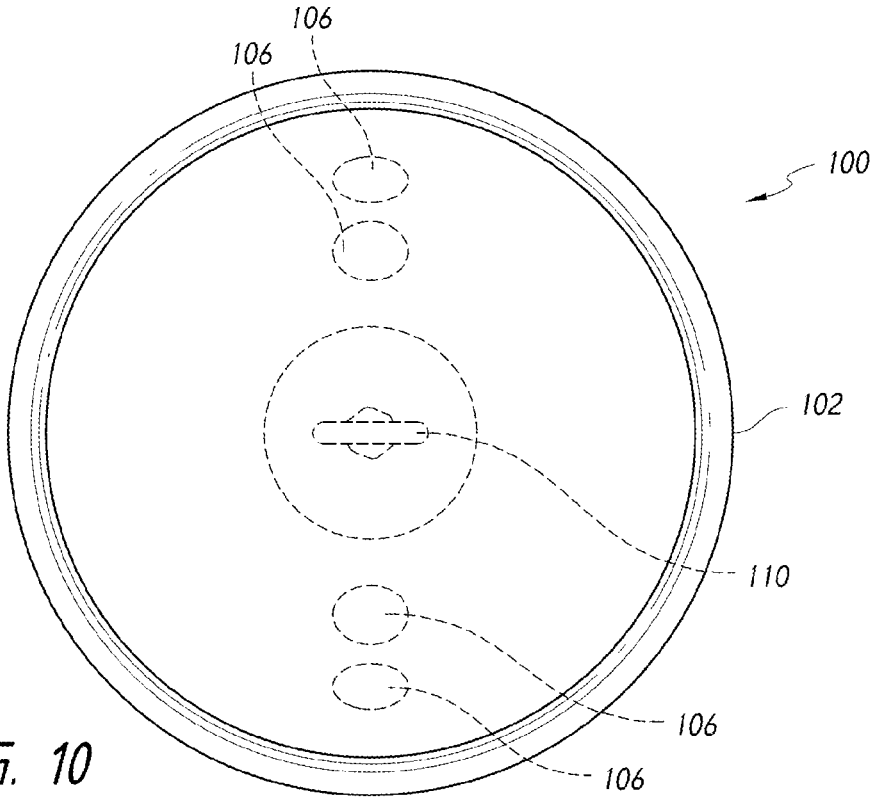
FIG. 10 is a bottom view of an exemplary kettlebell base having a main body and a handle.
Figure 11:
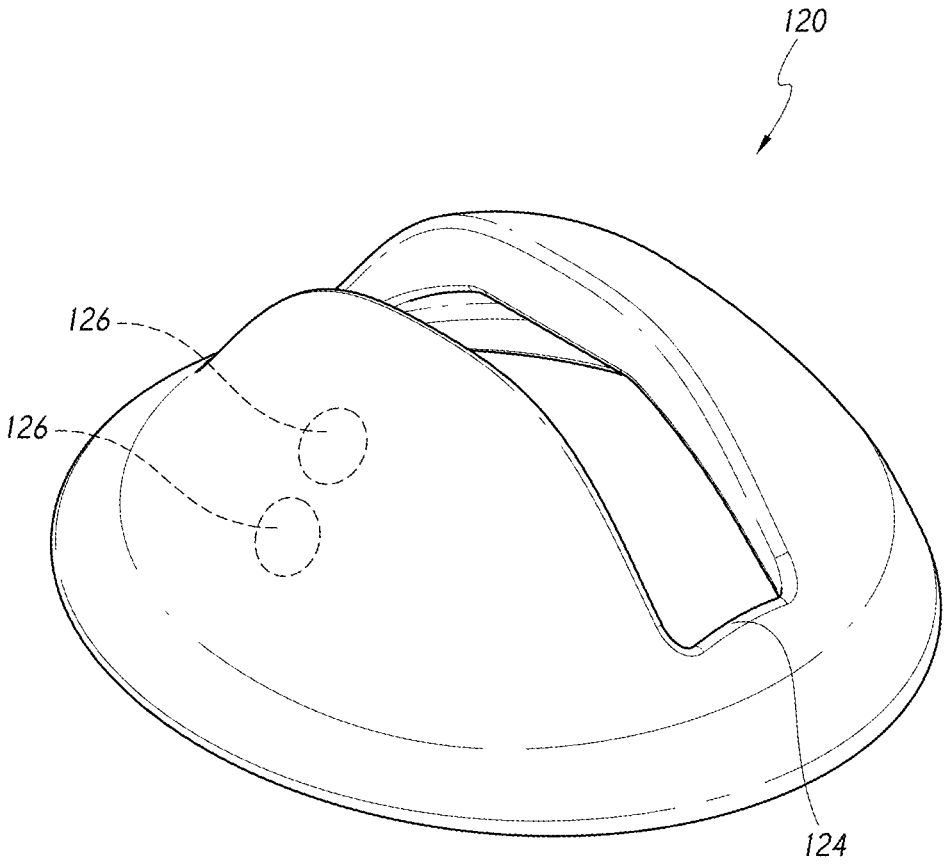
FIG. 11 is a perspective view of an exemplary top-loading nesting weight.
Figure 12:
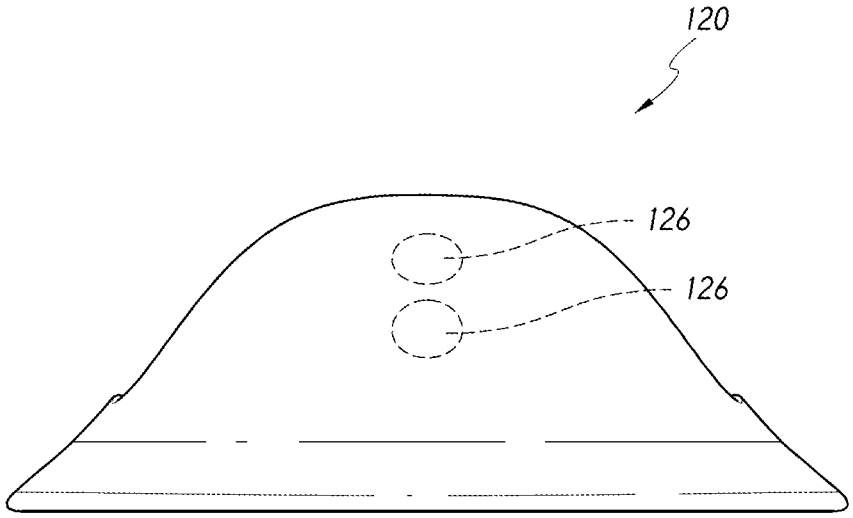
FIG. 12 is a front or back view of an exemplary top-loading nesting weight
Figure 13:
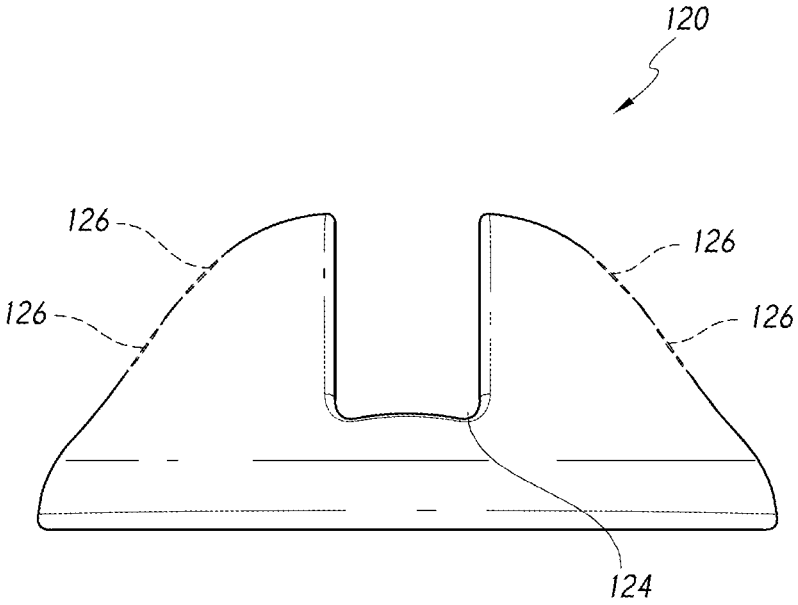
FIG. 13 is a side view of an exemplary top-loading nesting weight.
Figure 14:
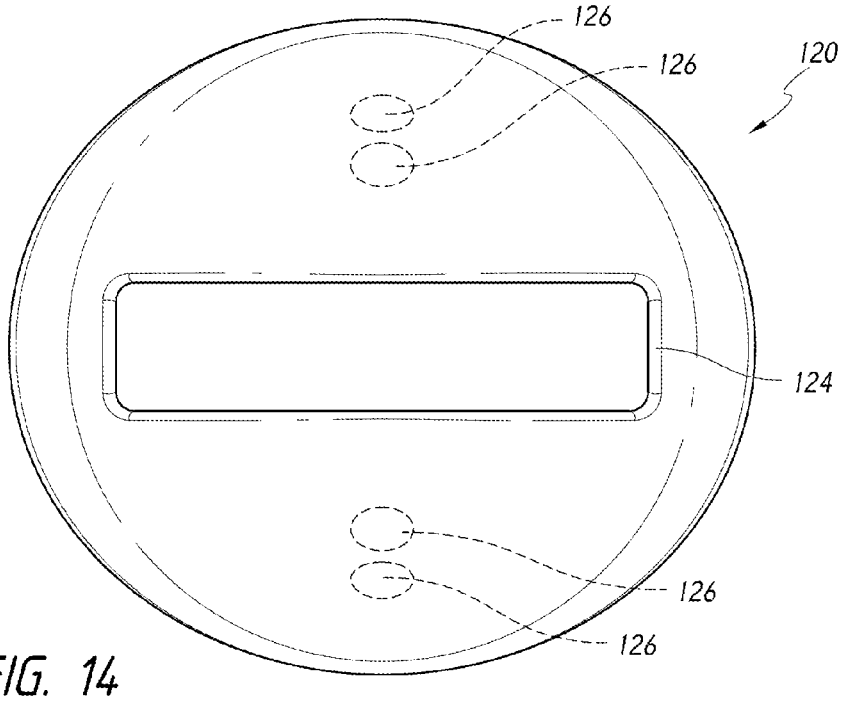
FIG. 14 is a top view of an exemplary top-loading nesting weight.
Figure 15:
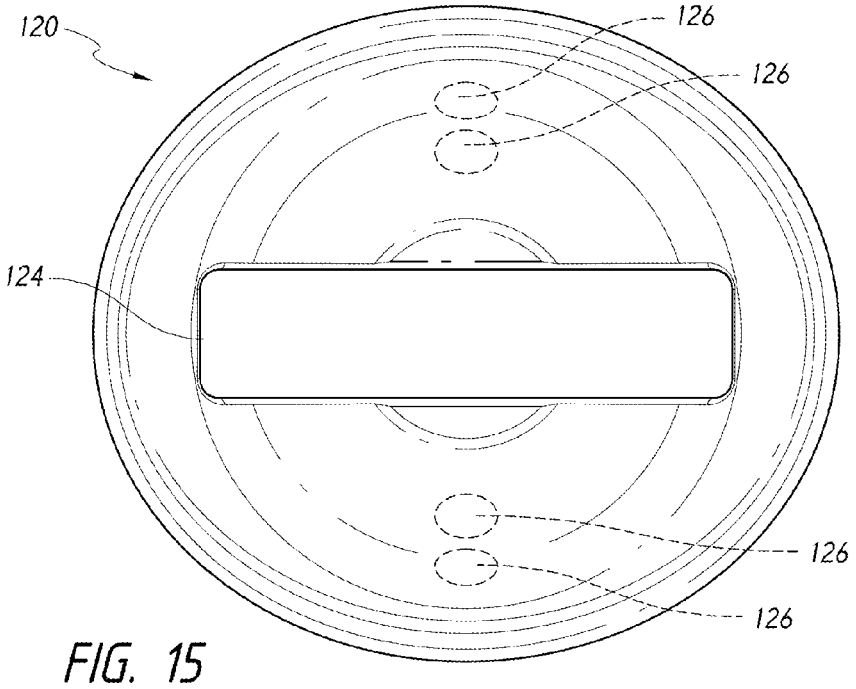
FIG. 15 is a bottom view of an exemplary top-loading nesting weight.

As shown in FIG. 5, the top-loading nesting weights 120 have an at least partial overhanging lip edge 130 (shown as a flared outer rim of the top-loading nesting weights 120) that creates a space or gap between the lower surface of the at least partial overhanging lip edge 130 and the surface thereunder. In the shown top-loading adjustable weight kettlebell system, the lip edge 130 (the flared outer rim) of the top-loading nesting weights 120 is a concavely curved portion toward the outer rim of the side wall such that the lip edge 130 has an overall flared configuration. The entire outer rim of the top-loading nesting weight 120 may have a lip edge 130 or one or more lip edge 130 may be provided (e.g. one or two flared lip edges 130). Except for the space or gap created by the at least partial overhanging lip edge 130, the majority of the lower surface of the top-loading nesting weight 120 is substantially flush with the upper surface of the main body 102 or the upper surface of the top-loading nesting weight 120 upon which it rests. Put another way, the lower surface of the at least partial overhanging lip edge 130 would be in spaced relation to the upper surface of the main body 102 if the top-loading nesting weight 120 was positioned on the kettlebell base 100 or would be in spaced relation to the upper surface of a previously loaded top-loading nesting weight 120 if the top-loading nesting weight 120 was positioned on another top-loading nesting weight 120.

The overhanging lip edge 130 may provide a finger grip for a user so that the top-loading nesting weights 120 may each be easily grasped by a user for loading and unloading onto the kettlebell base 100. Further, the spaced relationship between the lower surface of the at least partial overhanging lip edge and the surface therebelow allows movement between the top-loading nesting weight 120 and the main body 102 that allows a magnetic connection therebetween to be "broken." This movement may be based on leverage (e.g. a rocking motion) and/or a sliding motion that permits the separation of the strong magnets.

The top-loading nesting weights 120 may be molded or constructed using materials and manufacturing methods such as those described for the kettlebell base 100. Each top-loading nesting weight 120 may be made from or coated with materials that protect surfaces with which it may come in contact. Such materials may be, for example, plastic, rubber, polyurethane, or other material that would prevent the main body 102 of the kettlebell base 100 from scratching surfaces on which it is placed.

Securing Mechanism System

A securing mechanism system may be implemented as a two-part securing mechanism. The first part of the securing mechanism system (e.g. the main body securing mechanism(s) 106) is associated with the main body 102 of the kettlebell base 100. The second part of the securing mechanism system (e.g. the nesting weight securing mechanism(s) 126) is associated with the top-loading nesting weights 120. The two-part securing mechanisms are of a sufficient "strength" to secure (hold) the maximum weight as the top-loading adjustable weight kettlebell system is used in an exercise routine. The top-loading nesting weights 120 may be secured to the kettlebell base 100 using a securing mechanism system that includes the materials of the top-loading adjustable weight kettlebell system and/or securing mechanisms 106, 126 embedded in the main body 102 and/or the top-loading nesting weights 120. Using the securing mechanism system, the top-loading nesting weights 120 may be quickly loaded and/or unloaded without additional fastening or securing mechanisms, such as pins, dials, or bolts.

One or both of the two-part securing mechanisms may be a magnet that is embedded at least partially in the main body 102 and/or the top-loading nesting weights 120. In the embodiment shown in FIG. 4, the securing mechanisms 106, 126 are shown as being embedded in both the main body 102 and the top-loading nesting weights 120. The magnet securing mechanism may be any magnetic component having the strength to securely attach the weights as described above for exercise routines. Exemplary magnets include, but are not limited to rare earth magnets, neodymium magnets, and other magnets known or yet to be discovered. U.S. Pat. Nos. 8,303,732, 7,914,695, 7,547,365, 6,814,776 describe various types of magnets that may be suitable for this purpose. Magnets such as those available at unitednuclear.com, kjmagnetics.com, apexmagnets.com, and nwmagnet.com may be used as a magnet securing mechanism. One magnet known to be effective is the Neo Disc 0500×0375 available from nwmagnet.com.

All or part of one of the two-part securing mechanisms may be the materials from which the top-loading adjustable weight kettlebell system is constructed. For example, if one of the main body 102 and/or the top-loading nesting weights 120 is manufactured from a material such as cast iron and/or other magnetic material (e.g. steel, cobalt, and nickel), a magnet securing mechanism 106, 126 on an adjacent mating surface may secure (bind) to the magnetic material (the opposite magnetic securing mechanism 106, 126). The magnetic material, therefore, can be considered at least part of a magnetic securing mechanism 106, 126.

Figure 4:
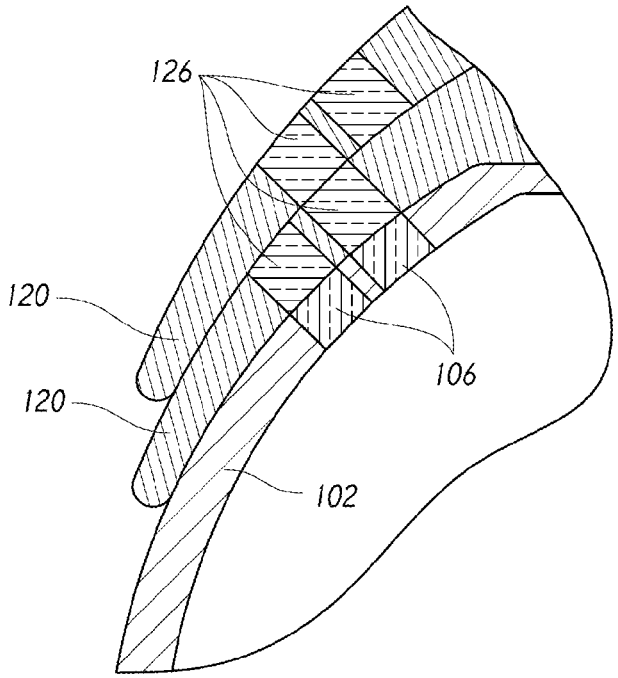
FIG. 4 is a partial cross-sectional view of an exemplary main body of the kettlebell base having main body securing mechanisms embedded therein and two exemplary top-loading nesting weights having nesting weight securing mechanisms embedded therein, the main body securing mechanisms and nesting weight securing mechanisms cooperatively (e.g. magnetically) securing the main body to at least the adjacent nesting weight, and adjacent nesting weight securing mechanisms cooperatively (e.g. magnetically) securing at least adjacent nesting weights.

As mentioned, one (or both) of the two-part securing mechanisms may be a magnet securing mechanisms 106, 126 that is embedded at least partially in the main body 102 and/or the top-loading nesting weights 120. The phrase "at least partially" refers to the fact that the magnetic securing mechanisms 106, 126 do not have to span the distance between the upper and lower surfaces of the main body 102 and/or the top-loading nesting weights 120 (as shown in FIG. 4). Instead, the magnetic securing mechanisms 106, 126 may, for example, only extend partially or may extend beyond the surfaces of the main body 102 and/or the top-loading nesting weights 120. For example, if the main body 102 and/or the top-loading nesting weights 120 are made from magnetic material, the main body 102 might not have a magnet securing mechanism 106 embedded and, instead, the top-loading nesting weights 120 may have a magnet embedded such that the magnet's magnetic force is only exerted from the lower surface of the top-loading nesting weights 120. In practice such an arrangement could be used by having the magnet on the lower surface of the first (adjacent the main body 104) top-loading nesting weight 120 secure (bind) to the magnetic material of the main body 104, the magnet on the lower surface of the second top-loading nesting weight 120 secure (bind) to the magnetic material of the first top-loading nesting weight 120, and the magnet on the lower surface of the nth top-loading nesting weight 120 secure (bind) to the magnetic material of the nth-1 top-loading nesting weight 120. The embedded magnet may also be covered by a coating of the material or some other coating that does not substantially interfere with the magnetic properties of the magnet. The embedded magnet may also slightly protrude above the upper or lower surfaces of the main body 102 and/or the top-loading nesting weights 120.

The shown adjustable weight kettlebell system includes at least one main body securing mechanism 106 (shown as two securing mechanisms 106) that may be located on each side of the main body 102. The shown adjustable weight kettlebell system also includes at least one nesting weight securing mechanism 126 (shown as two securing mechanisms 126) that may be located in each of the top-loading nesting weights 120. Using this adjustable weight kettlebell system, a first top-loading nesting weight 120 may be magnetically secured (bound) to the main body 102. Additional top-loading nesting weights 120 may be magnetically secured (bound) to adjacent/abutting top-loading nesting weights 120 and/or the main body 102. The main body securing mechanism(s) 106 and the nesting weight securing mechanism(s) 126 may be jointly thought of as a securing mechanism system.

The two-part securing mechanisms are of a sufficient "strength" to hold the maximum weight. For example, if the top-loading nesting weight 120 has a maximum weight of ten pounds (10 lbs), and there could be up to four stacked top-loading nesting weights 120, the strength of the two-part securing mechanism between the main body 102 and the adjacent top-loading nesting weight 120 would have an attraction strength sufficient to hold forty pounds (40 lbs). As another example, if the top-loading nesting weight 120 has a maximum weight of eight pounds (8 lbs), and there could be up to six stacked top-loading nesting weights 120, the strength of the two-part securing mechanism between the main body 102 and the adjacent top-loading nesting weight 120 would have an attraction strength sufficient to hold forty-eight pounds (48 lbs). The "strength" may be augmented to for purposes of safety or intended use. The strength can be controlled by adding or subtracting securing mechanisms 106, 126, increasing or decreasing the size of the securing mechanisms 106, 126, and/or increasing or decreasing the strength of the securing mechanisms 106, 126.

The shape of the top-loading nesting weight 120 allows for a movement between the top-loading nesting weight 120 and the main body 102 that allows the magnetic connection to be "broken." This movement may be based on leverage and/or a sliding motion that permits the separation of the strong magnets.

In other preferred top-loading adjustable weight kettlebell systems, the top-loading nesting weights 120 may be secured to the kettlebell base 100 with mechanical securing mechanisms. For example, top-loading nesting weights 120 may be mechanically secured to each other and/or the kettlebell base 100 via one or more cotter pins, bolts, dials, latches, flanges, clips, or other securing mechanisms.

In still other preferred top-loading adjustable weight kettlebell systems, the top-loading adjustable weight kettlebell system may include a nesting weight securing mechanism that is loaded on top of and encloses at least a top portion of the top-loading nesting weights 120. In this additional example, the nesting weight securing mechanism may fasten to the kettlebell base 100 to secure the position of the top-loading nesting weights 120. The nesting weight securing mechanism may be fastened to the kettlebell base 100 via one or more cotter pins, bolts, dials, latches, flanges, clips, or other fastening mechanisms.

In still other preferred top-loading adjustable weight kettlebell systems, the top-loading adjustable weight kettlebell system may include a wrap nesting weight securing mechanism that wraps around the main body 102 and the top-loading nesting weights 120 either longitudinally or latitudinally. The wrap nesting weight securing mechanism may be an elastic or neoprene wrap. The wrap nesting weight securing mechanism may be tubular or may be an expanse with connectors (e.g. hook and loop fabric, ties, hooks, or other known or yet to be discovered connectors). An advantage of the wrap nesting weight securing mechanism is that it would add padding that protects a user's arms as well as surfaces that may come into contact with the adjustable weight kettlebell system.

Although discussed individually, still additional preferred top-loading adjustable weight kettlebell systems may use more than one type of securing mechanisms. For example, both magnet securing mechanisms and mechanical securing mechanisms may be used.

Attachment Structure for Dynamic Exercise

Figure 3:
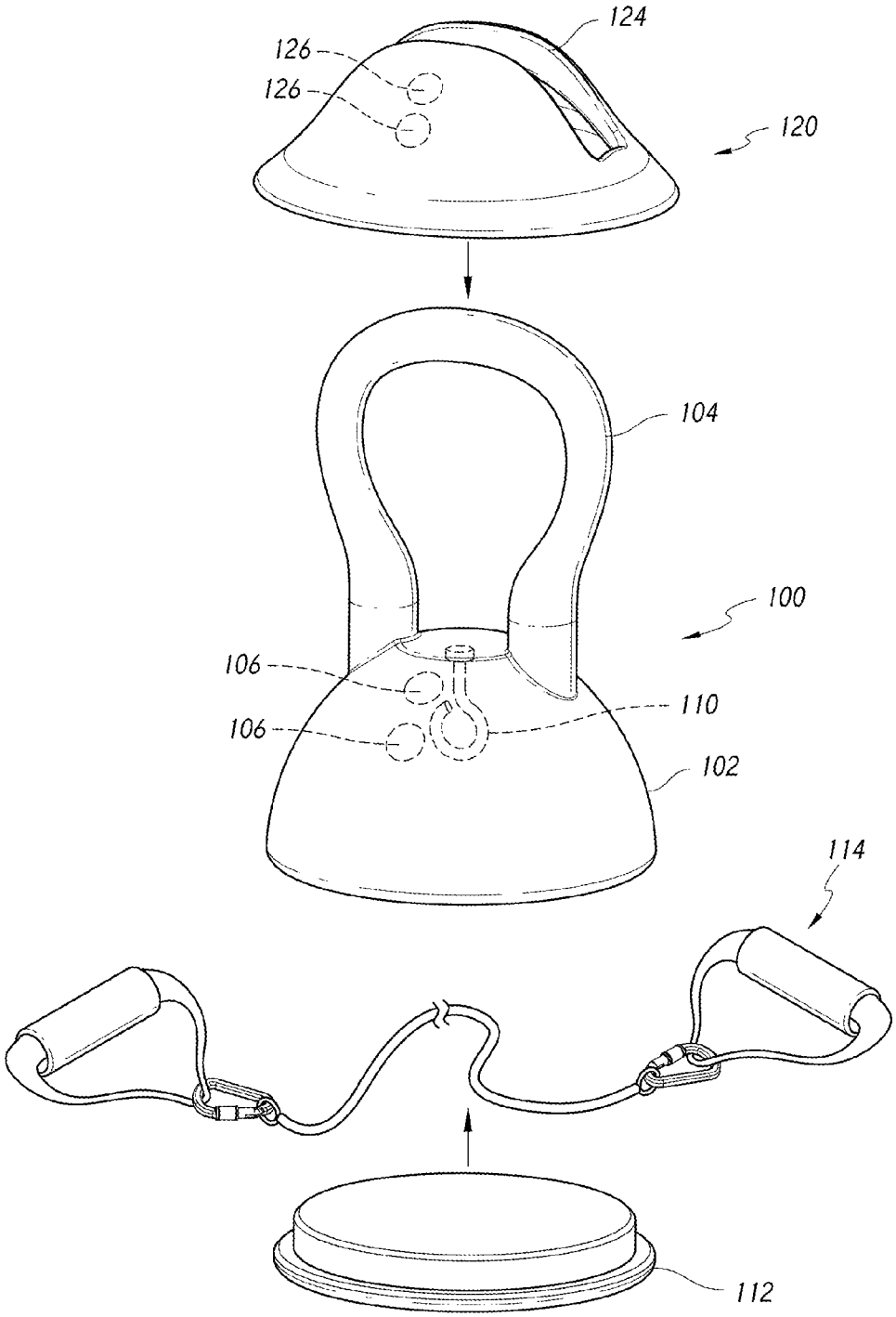
FIG. 3 is an exploded view of an exemplary top-loading adjustable weight kettlebell system including an exemplary top-loading nesting weight, a kettlebell base, exemplary storable components, and a body enclosure cover.

As shown in FIGS. 2, 3, and 16, the top-loading adjustable weight kettlebell system may include an attachment structure 110 (e.g. an attachment ring, hook, hook-eye). A preferred example of a top-loading adjustable weight kettlebell system includes an attachment structure 110 recessed within a bottom cavity of the kettlebell base 100. An additional resistance system or device may be attached directly or indirectly to the attachment structure 110. The resistance system or device may be, for example, a flexible lead (e.g. at least one resistance band, tubing, or bungee cord) attached to a sturdy surface (e.g. a door or door jamb) using one or more of a linking device (e.g. a carabiner and/or door anchor). FIG. 16 shows the top-loading adjustable weight kettlebell system attachment structure 110 within the bottom cavity of the kettlebell base 100. A carabiner is attached to the attachment structure 110. A flexible lead is attached to the carabiner on one end and a door anchor (not shown) at the other end. The door anchor is shown as being attached to a door. The resistance system or device may also be, for example, mechanical weights attached directly or indirectly to the attachment structure 110. Attachment of the exemplary top-loading adjustable weight kettlebell system to the additional resistance mechanism(s) may provide dynamic or progressive resistance to the kettlebell, thereby allowing a user to perform additional types of exercises.

"Bottom Weight"

Figure 17:
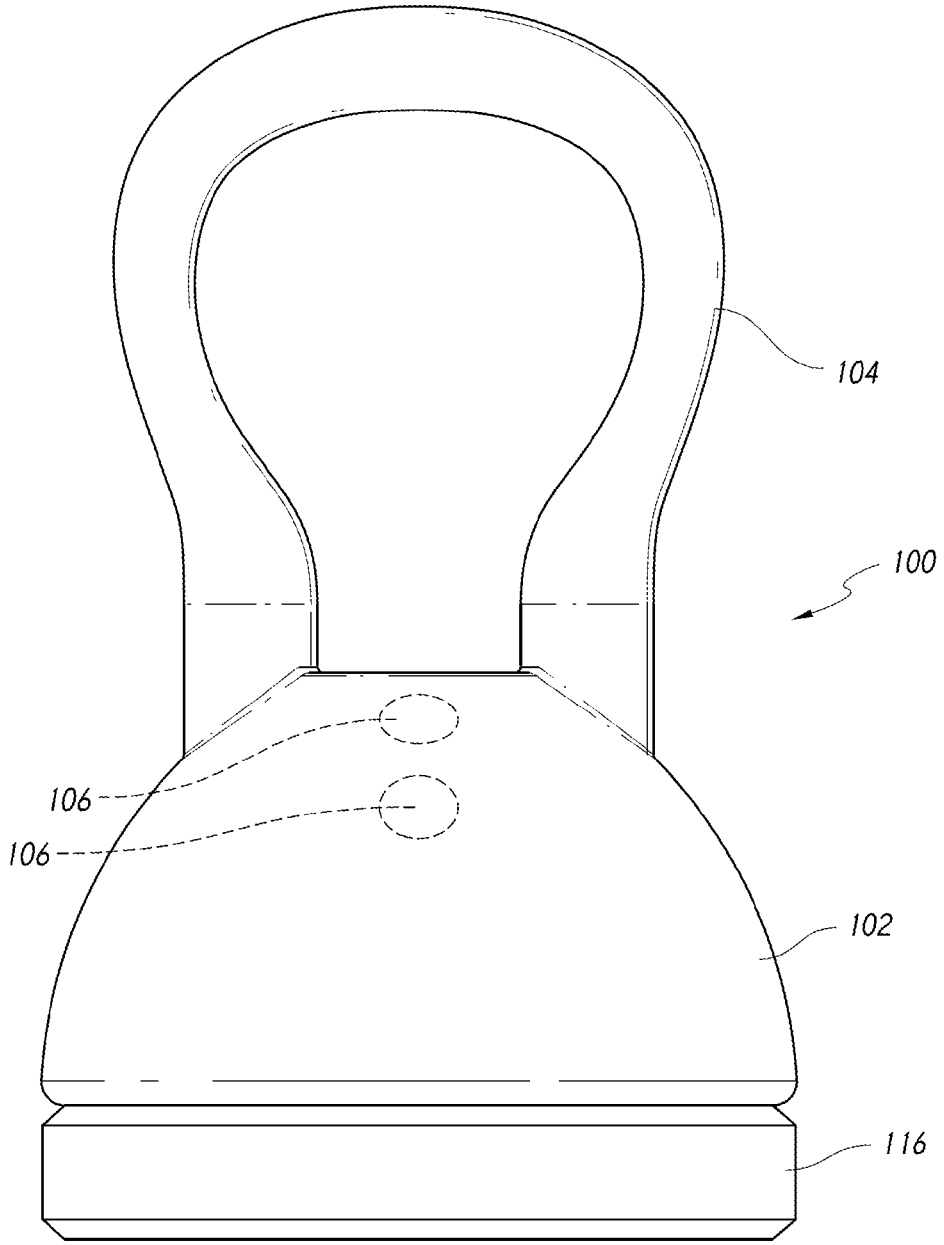
FIG. 17 is a front view of an alternative top-loading adjustable weight kettlebell system with an alternative kettlebell base attached to an exemplary bottom weight.

Although the kettlebell base 100 is designed to be used with a top-loading nesting weight 120, one or more additional bottom weight 116 may be designed to be interconnectable with the bottom portion of the main body 102 and/or the body enclosure cover 112. FIG. 17 shows an exemplary bottom weight 116. The actual structure of the interconnection may be a snap fit, screw, or other connections known or yet to be discovered. The bottom weight may include an aperture through which the attachment structure 110 may be accessed.

Alternative Shapes

Although the exemplary top-loading adjustable weight kettlebell systems described herein have a shape as shown and described, alternative top-loading adjustable weight kettlebell systems could have alternative shapes. For example, FIGS. 18 and 19 show examples alternative kettlebell bases 140, 160 with main bodies 142, 162 and handles 144, 164 having alternative shapes. Additional alternative shapes of the bodies may include cones (or rounded versions of a cone), pyramids (or rounded versions of a pyramid), partial polyhedrons (or rounded versions of a partial polyhedron), three-dimensional shapes with U-shaped cross-sections, or other appropriate shapes. The top-loading nesting weights 150, 170 (exemplary versions of which are shown in phantom) would have a shape suitable for nesting with the shown main bodies 142, 162.

Comparison with Known Systems

As set forth in the Background, adjustable weight kettlebells having weights that attach below the handle are known. These bottom weights are attached using various types of mechanical connectors. A user must open the mechanical connector, load the weight, and then close the mechanical connector. The present invention recognizes the danger of the possibility that the mechanical connectors will not be properly closed after each loading (user error) and, if the mechanical connectors are not properly closed, the bottom weights might fall. The present invention also recognizes the danger of the possibility that the mechanical connectors will fail causing the bottom weights to fall. Instead, preferred top-loading adjustable weight kettlebell systems have a handle 104 securely attached or integral with the main body 102. The top-loading nesting weights 120 are above the main body 102. There is no way for the top-loading nesting weights 120 to fall.

Kettlebells are generally used with the main bodies below the handle or in a swinging motion. For these exercises, no securing mechanisms 106, 126 would be needed at all. A few exercise routines do invert the kettlebells such that the handle is below the main body. In such cases, the securing mechanisms 106, 126 may be strong enough to hold more than the possible weight. User error, however, is not possible with magnetic securing mechanisms 106, 126. The magnetic securing mechanisms 106, 126 secure automatically. The nesting and through-handle configuration provide additional assurance that side-to-side motion of the top-loading nesting weights 120 will be reduced or eliminated. Accordingly, the top-loading adjustable weight kettlebell systems described herein are safer than known adjustable weight kettlebell systems.

It is to be understood that the inventions, examples, and embodiments described herein are not limited to particularly exemplified materials, methods, and/or structures. Further, all foreign and/or domestic publications, patents, and patent applications cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention use various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following paragraphs are intended to cover all of the generic and specific features of the invention herein described and all statements of the scope of the invention that, as a matter of language, might be said to fall therebetween.

The invention claimed is:

1. A top-loading adjustable weight kettlebell system, comprising:

(a) a kettlebell base, said kettlebell base comprising an integral main body and an integral handle, said handle upwardly extended from said main body, said handle forming a loop with said main body;

(b) wherein said main body comprises a flat bottom portion configured to rest upon a ground surface during use; and (c) at least one top-loading nesting weight, said at least one top-loading nesting weight comprising an enclosed handle opening;

(d) wherein said at least one top-loading nesting weight is loadable onto said kettlebell base by insertion of said handle through said enclosed handle opening; and (e) an attachment structure, wherein said attachment structure comprises an eye hook for attaching a carabineer or flexible lead.

2. The top-loading adjustable weight kettlebell system of claim 1, further comprising a two-part securing mechanism for securement between said kettlebell base and said at least one top-loading nesting weight, a first part of said two-part securing mechanism comprising said kettlebell base and a second part of said two-part securing mechanism comprising said at least one top-loading nesting weight.

3. The top-loading adjustable weight kettlebell system of claim 1, further comprising a two-part securing mechanism for securement between said kettlebell base and said at least one top-loading nesting weight, wherein at least one part of said two-part securing mechanism is a magnet.

4. The top-loading adjustable weight kettlebell system of claim 1, further comprising a securing mechanism for securement between said kettlebell base and said at least one top-loading nesting weight, wherein said securing mechanism is a magnetic securing mechanism, said magnetic securing mechanism comprising at least one magnet associated with said top-loading nesting weight and at least one magnet associated with said main body.

5. The top-loading adjustable weight kettlebell system of claim 1, wherein said main body has a wider bottom portion having a substantially circular shape, a narrower top portion having a substantially circular shape, and a curved side wall extended between said narrower top portion and said wider bottom portion.

6. The top-loading adjustable weight kettlebell system of claim 1, said main body defining a cavity.

7. The top-loading adjustable weight kettlebell system of claim 6, further comprising a body enclosure cover.

8. The top-loading adjustable weight kettlebell system of claim 7, wherein said cavity is internally threaded and said body enclosure cover is externally threaded to be screwed into said cavity.

9. The top-loading adjustable weight kettlebell system of claim 7, wherein said body enclosure cover comprises additional weights.

10. The top-loading adjustable weight kettlebell system of claim 1, wherein said attachment structure is suitable for attachment to a resistance system or device.

11. The top-loading adjustable weight kettlebell system of claim 1, wherein said attachment structure is positioned within a cavity of said main body.

12. The top-loading adjustable weight kettlebell system of claim 1, wherein said handle is elongated to accommodate a plurality of stacked top-loading nesting weights.

13. The top-loading adjustable weight kettlebell system of claim 12, wherein said handle extends fully through and above the top portion of the top-most top-loading nesting weight.

14. The top-loading adjustable weight kettlebell system of claim 1, wherein said at least one top-loading nesting weight has a substantially convex upper surface and a substantially concave lower surface.

15. The top-loading adjustable weight kettlebell system of claim 1, said at least one top-loading nesting weight having a substantially convex upper surface and a substantially concave lower surface, said substantially concave lower surface for nesting with an upper surface of said main body or an upper surface of a lower adjacent nesting top-loading nesting weight.

16. The top-loading adjustable weight kettlebell system of claim 1, said at least one top-loading nesting weight having an at least partial overhanging lip edge, said at least partial overhanging lip edge having a lower surface that is in spaced relation with a surface therebelow.

17. A top-loading adjustable weight kettlebell system, comprising a kettlebell base, and at least one top-loading nesting weight defining an enclosed handle opening wherein said at least one top-loading nesting weight is semi-spherically shaped; said kettlebell base comprising an integral main body, wherein said integral main body comprises a cavity, and an integral handle, said integral handle upwardly extended from said main body.

18. The top-loading adjustable weight kettlebell system of claim 17, further comprising a body enclosure cover.

19. The top-loading adjustable weight kettlebell system of claim 18, wherein said cavity is internally threaded and said body enclosure is externally threaded to be screwed into said cavity.

20. The top-loading adjustable kettlebell system of claim 18, wherein said body enclosure cover comprises additional weights.

21. The top-loading adjustable weight kettlebell system of claim 17, wherein further comprising an attachment structure associated with said main body, wherein said attachment structure is positioned within a cavity of said main body.

* * * * *